US009198497B2

(12) United States Patent
Elam

(10) Patent No.: US 9,198,497 B2
(45) Date of Patent: Dec. 1, 2015

(54) HOOK FOR SHOULDER SLING

(76) Inventor: Timothy B. Elam, Boise, ID (US)

( * ) Notice: Subject to any disclaimer, the term of this patent is extended or adjusted under 35 U.S.C. 154(b) by 38 days.

(21) Appl. No.: 13/421,539

(22) Filed: Mar. 15, 2012

(65) Prior Publication Data

US 2013/0068807 A1 Mar. 21, 2013

Related U.S. Application Data

(60) Provisional application No. 61/453,002, filed on Mar. 15, 2011.

(51) Int. Cl.

| | |
|---|---|
| ***A45F 3/00*** | (2006.01) |
| ***A45F 5/00*** | (2006.01) |
| ***F41C 23/02*** | (2006.01) |
| ***F41C 33/00*** | (2006.01) |

(52) U.S. Cl.

CPC ... *A45F 3/00* (2013.01); *A45F 5/00* (2013.01); *F41C 23/02* (2013.01); *F41C 33/002* (2013.01); *F41C 33/007* (2013.01); *A45F 2003/001* (2013.01); *A45F 2200/0591* (2013.01)

(58) Field of Classification Search

CPC ..... A45F 3/12; A45F 5/02; A45F 2003/12; A45F 2003/001; A45F 3/00; A45F 5/00; A41D 27/26; F41C 33/00; F41C 33/001; F41C 33/002; F41C 23/02; A41F 15/02; A41F 15/007; A45C 13/30; F16B 2/08; A44B 11/12

USPC ..... 224/257, 264; 248/647, 227.1, 227.4

See application file for complete search history.

(56) References Cited

U.S. PATENT DOCUMENTS

| | | | | |
|---|---|---|---|---|
| 954,765 | A | 4/1910 | Rune | |
| 2,748,390 | A | 6/1956 | Carlson | |
| 3,940,039 | A | 2/1976 | Sasaki | |
| 4,386,723 | A * | 6/1983 | Mule | 224/150 |
| 4,881,672 | A | 11/1989 | Gustafson | |
| 5,450,993 | A * | 9/1995 | Guerrero et al. | 224/246 |
| 7,434,301 | B1 | 10/2008 | Johnson | |
| 2006/0289575 | A1 * | 12/2006 | Chou | 224/264 |
| 2007/0011850 | A1 * | 1/2007 | Downing et al. | 24/16 R |
| 2009/0193631 | A1 | 8/2009 | Liu | |
| 2012/0193378 | A1 | 8/2012 | Schroedel | |

* cited by examiner

*Primary Examiner* — Adam Waggenspack

(74) *Attorney, Agent, or Firm* — Pedersen and Company, PLLC; Ken J. Pedersen; Barbara S. Pedersen

(57) ABSTRACT

Several versions of a holder for a shoulder sling or strap are described. Preferably, the holder may be secured to or manufactured in the shoulder strap of a backpack or a garment. The holder has a generally horizontal base with at least one preferably integrally formed upstanding prong near one end of the base. Near the other end of the base, a moveable clamp is secured, and extends over the middle region of the base to engage with the upstanding prong. This way, for example, when the clamp is engaged with the prong, it extends over and cooperates to hold a rifle sling on the middle region of the base beneath the clamp.

16 Claims, 12 Drawing Sheets

HOOK FOR SHOULDER SLING

This application claims priority from U.S. Provisional Patent Application Ser. No. 61/453,002, filed Mar. 15, 2011, the entire disclosure of which is incorporated herein by this reference.

BACKGROUND OF THE INVENTION

1. Field of the Invention

This invention relates generally to backpacks and garments with shoulder straps. More specifically, this invention relates to a holder, typically for holding other straps or slings, which holder is preferably secured to a shoulder strap. The holder is especially well-adapted to restrain the sling of a rifle, for example, to the shoulder strap of a backpack or garment of a hunter or soldier, for example, and thereby secure the rifle to the person wearing the backpack or garment.

2. Related Art

U.S. Pat. No. 2,748,390 (Carlson), discloses a malleable metal tang which is sewn onto the shoulder of a garment. The tang may be bent up and around to form a retaining hook for a rifle sling. This way, the retainer can restrain the sling of a rifle from sliding off the shoulder of a wearer.

U.S. Pat. No. 3,940,039 (Sasaki), discloses a shoulder sling retainer which may be buttoned or otherwise secured to the shoulder of a garment. The retainer has a pivoted hook at its distal end, the hook being freely rotatable in the proximal direction towards the wearer, but limited in movement in the distal direction. This way, the retainer can restrain the sling of a rifle.

SUMMARY OF THE INVENTION

This invention is a holder for a shoulder sling. Preferably, the holder may be secured to the shoulder strap of a backpack. Also, the holder may be secured to the shoulder strap section of a garment, like a vest. Also, the holder may be built into, so that it is integrally contained within, the shoulder strap of a backpack, or built into the shoulder strap section of a garment.

The instant holder has a generally horizontal base portion with at least one preferably integrally formed upstanding prong. Preferably there are two prongs, spaced-apart symmetrically about the longitudinal axis of the horizontal base portion. Two prongs may be joined together by a bridge over the longitudinal axis to make a reinforced buttress. Preferably, the prong is closer to the distal end of the base, relative to the wearer. Closer to the proximal end of the base, that is, nearer the wearer, there is a moveable clamp which is secured proximally but extends distally to cooperate and engage with the upstanding prong. This way, when the clamp is engaged with the prong, it extends over and fits over the middle portion of the base. If a rifle sling, for example, is laid over the middle portion of the base when the holder is secured to a strap of a backpack or garment on a wearer, and then the clamp is engaged with the prong, the rifle sling will be held securely under the clamp of the holder to the backpack or garment of the wearer. Also, due to the upstanding prong, the rifle sling may be conveniently more loosely held by the holder, even without the clamp being engaged over the sling, but by being disengaged or engaged under it.

DETAILED DESCRIPTION OF THE INVENTION

Referring to the Figures, there are shown two, but not all, of the embodiments of the subject hook for shoulder sling.

Figure 1:
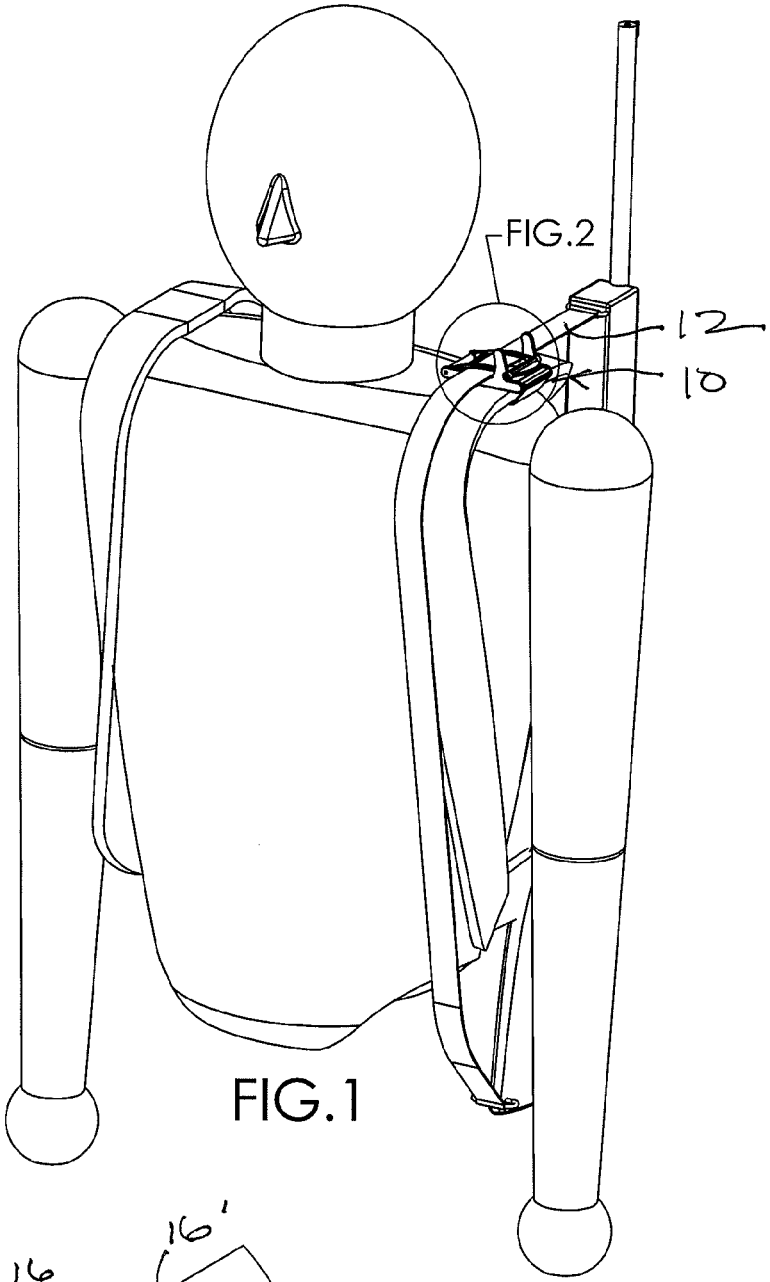
FIG. 1 is a front, top, perspective, schematic view of one embodiment of the invention attached to the shoulder strap of a backpack with the clamp engaged over a rifle sling.

Referring to FIG. 1, there is depicted hook 10 for rifle shoulder sling 12 according to one embodiment of the invention. Sling 12 is for a rifle being carried on the left shoulder of a wearer in this Figure. Also in this Figure, the hook 10 has its clamp engaged over the sling to securely hold the rifle sling 12.

Figure 2:
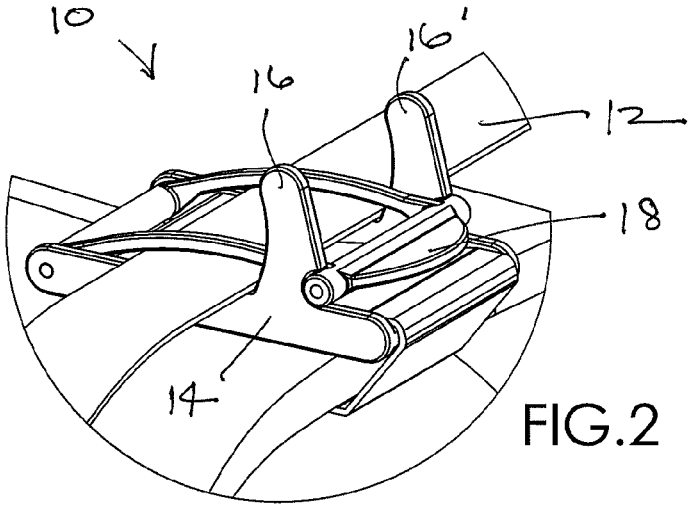
FIG. 2 is a detail view of the circled region in FIG. 1.

FIG. 2 depicts hook 10 and sling 12 in more detail. Hook 10 has base portion 14 with, in this case, two integrally formed upstanding prongs 16 and 16' located towards the end of base portion farthest away from the wearer, that is, the distal end. Preferably, prongs 16 and 16' are between about ½ to 1½ inches high off the top of the middle portion of base 114. Near the end of base portion 14 nearest the wearer, that is, the proximal end, there is a clamp 18 which is secured proximally, but extends distally, to cooperate and engage with the distal ends of upstanding prongs 16 and 16'. This way, when clamp 18 is extended over and latched onto prongs 16 and 16' as shown in the Figure, the middle portion of base 14 is underneath clamp 18. This way, rifle sling 12 may be placed on the middle portion of base 14, then covered by clamp 18, and securely held to the shoulder of the wearer by holder 10 when clamp 18 is engaged with the upstanding prongs 16 and 16' over the sling.

Figure 3:
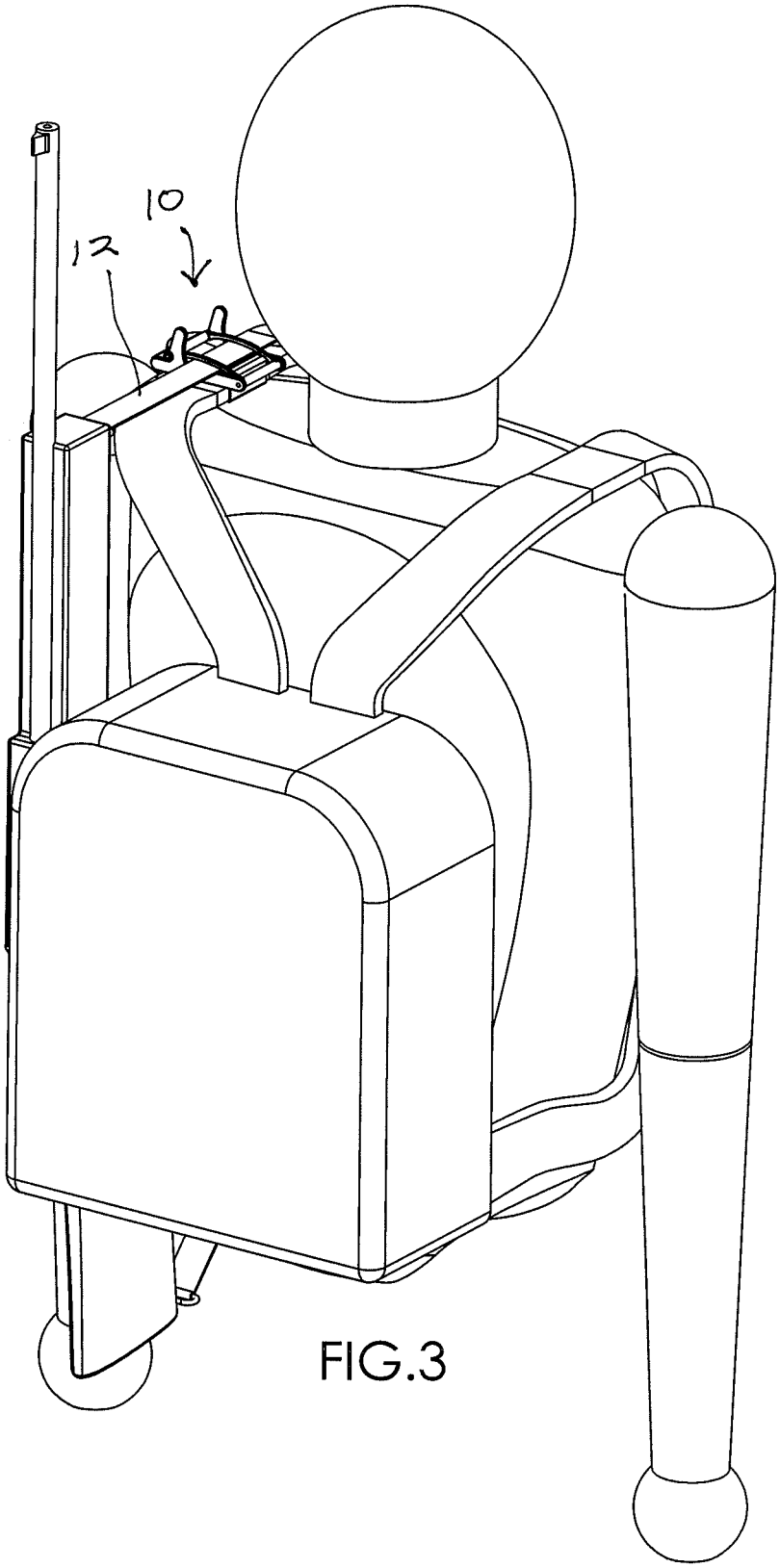
FIG. 3 is a rear view of the view depicted in FIG. 1.

FIG. 3 depicts hook 10 for rifle shoulder sling 12 as in FIG. 1, but from a rear view.

Figure 4:
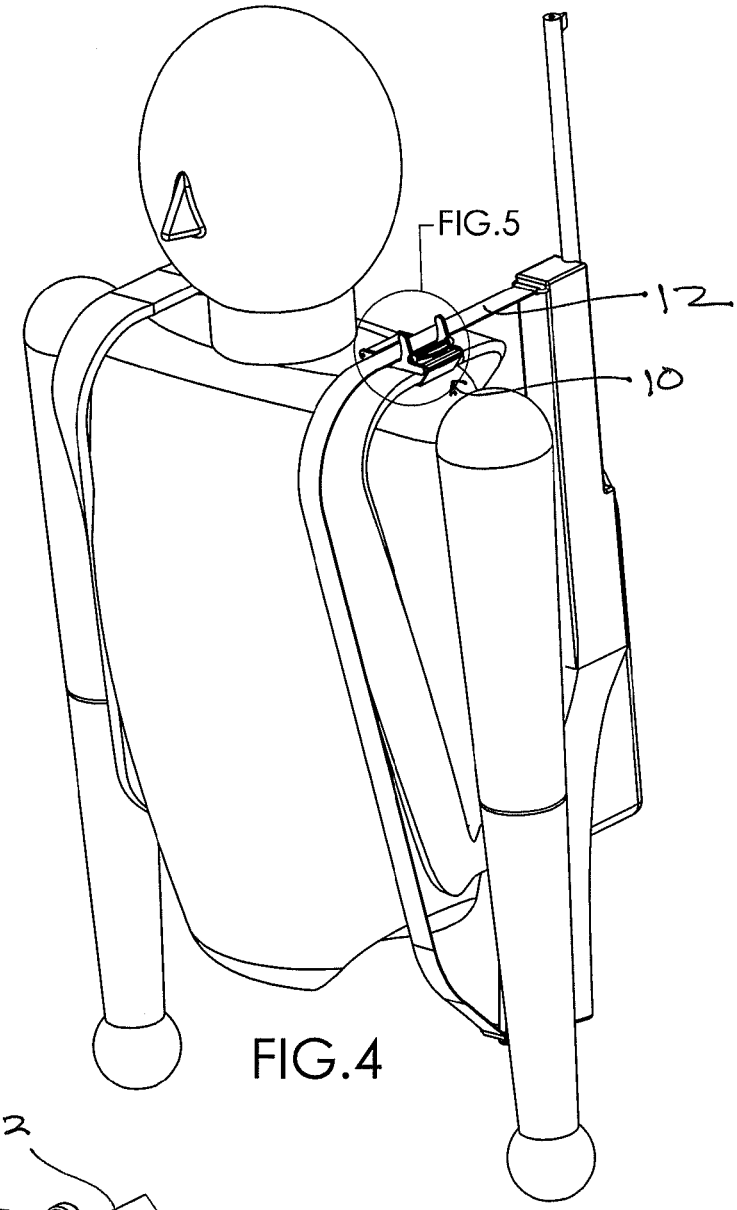
FIG. 4 is a view like FIG. 1, but with the clamp engaged under a rifle sling.
Figure 5:
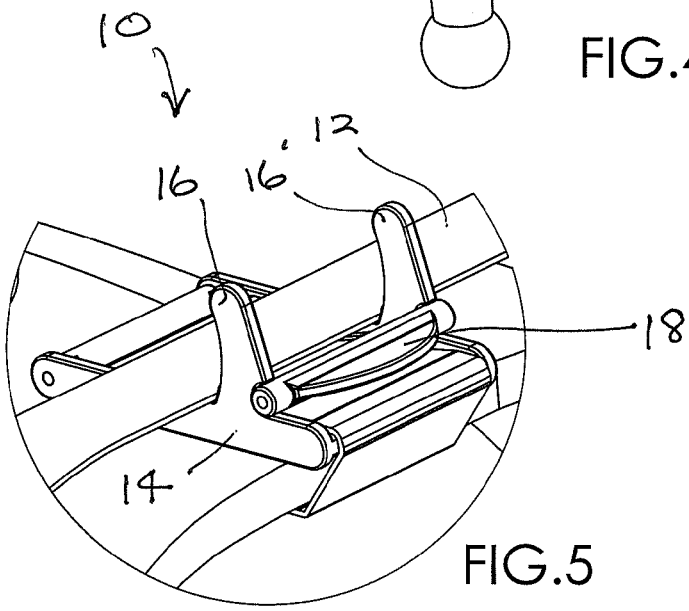
FIG. 5 is a detail view of the circled region in FIG. 4.

FIG. 4 is a view like FIG. 1, and FIG. 5 is a view like FIG. 2, except in FIGS. 4 and 5 clamp 18 is engaged on prongs 16 and 16' before the rifle sling 12 is a placed on the middle portion of base 14, that is, clamp 18 is engaged under the sling 12. This way, the rifle sling 12 may still be conveniently held by holder 10, but not as securely as when the clamp 18 is engaged over the sling. This way, the wearer may remove the sling 12 with the rifle very quickly, yet still have the sling restrained somewhat by hook 10 before removal.

Figure 6:
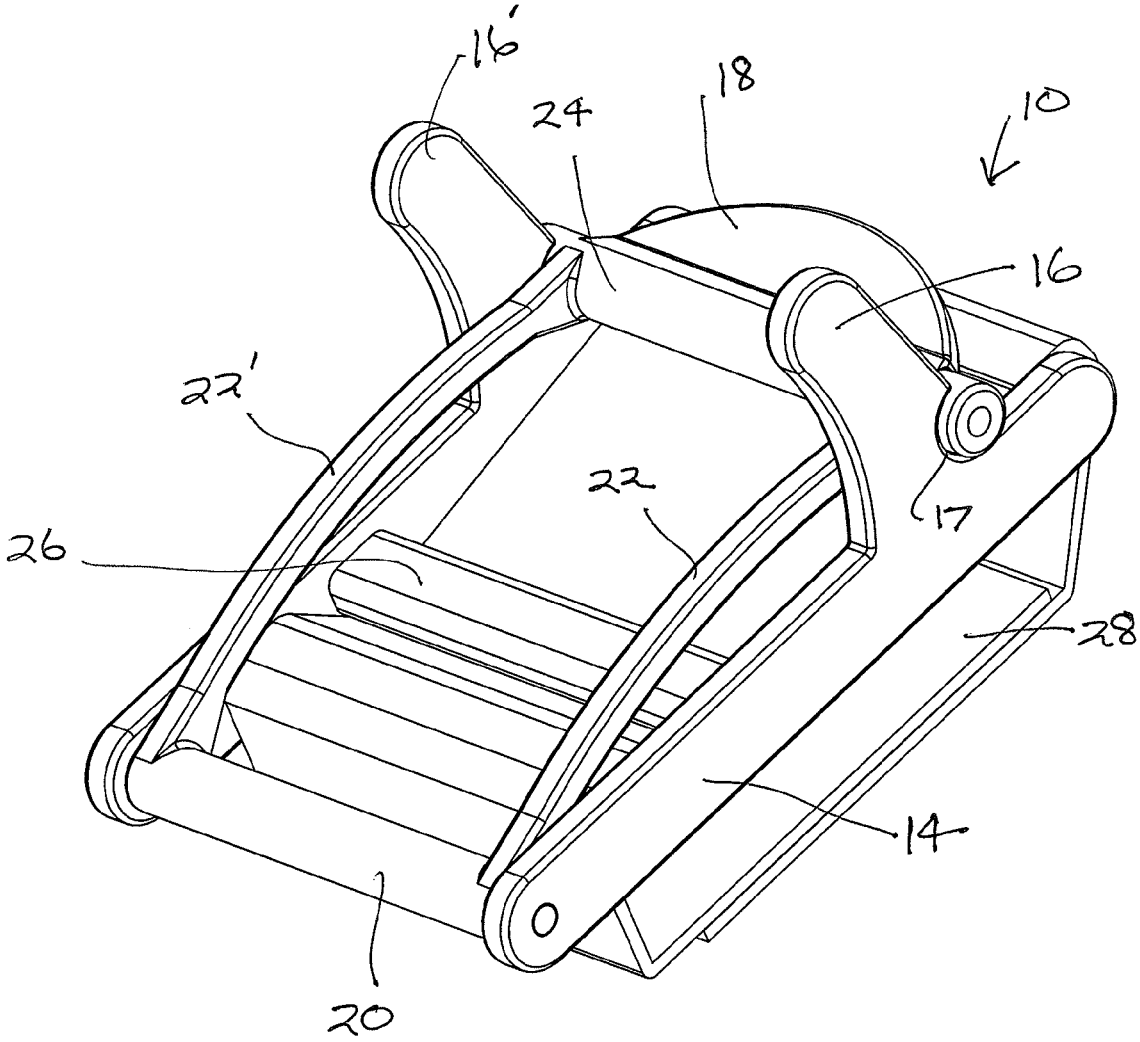
FIG. 6 is a top, proximal, perspective view of the holder embodiment depicted in FIGS. 1-5, with the clamp and the holder fastening strap engaged.

FIG. 6 depicts an isolated view of the holder 10 without rifle sling 12 or a wearer being pictured. Again holder 10 has a generally horizontal base portion 14 and two, integral upstanding prongs 16 and 16'. Moveable clamp 18 extends from near the proximal end of base 14, where clamp 18 is secured, to upstanding prongs 16 and 16', more towards the distal end of base 14. In this case, clamp 18 is made of a stretchable elastic material and comprises an attachment end 20 to the proximal end of base 14, and two substantially parallel stretchable legs 22 and 22' near the lateral sides of base 14 which extend to and even slightly past prongs 16 and 16', respectively. The distal ends of legs 22 and 22' terminate at common securement end 24 of the clamp 18, which in this case is a transverse cylinder slightly longer than the distance between prongs 16 and 16'. Conveniently, securement end 24 has a flat, distal end tab for being easily grabbed by the thumb and fingers of a hand of the wearer. Also effectively, securement end 24 is adapted to rest securely when engaged with prongs 16 and 16' in lower, distal indent sections 17 and 17', respectively of the prongs.

Also depicted in FIG. 6 is first transverse bar 26 which extends between the lateral sides of base 14, and holder fastening strap 28 which threads through the base 14 under first transverse bar 26, over second transverse bar 30 and over third transverse bar 32 (bars 30 and 32 not being shown in this Figure). This way, fastening strap 28 may secure hook 10 to a strap or sling as shown in FIGS. 1 and 2 for sling 12.

Figure 7:
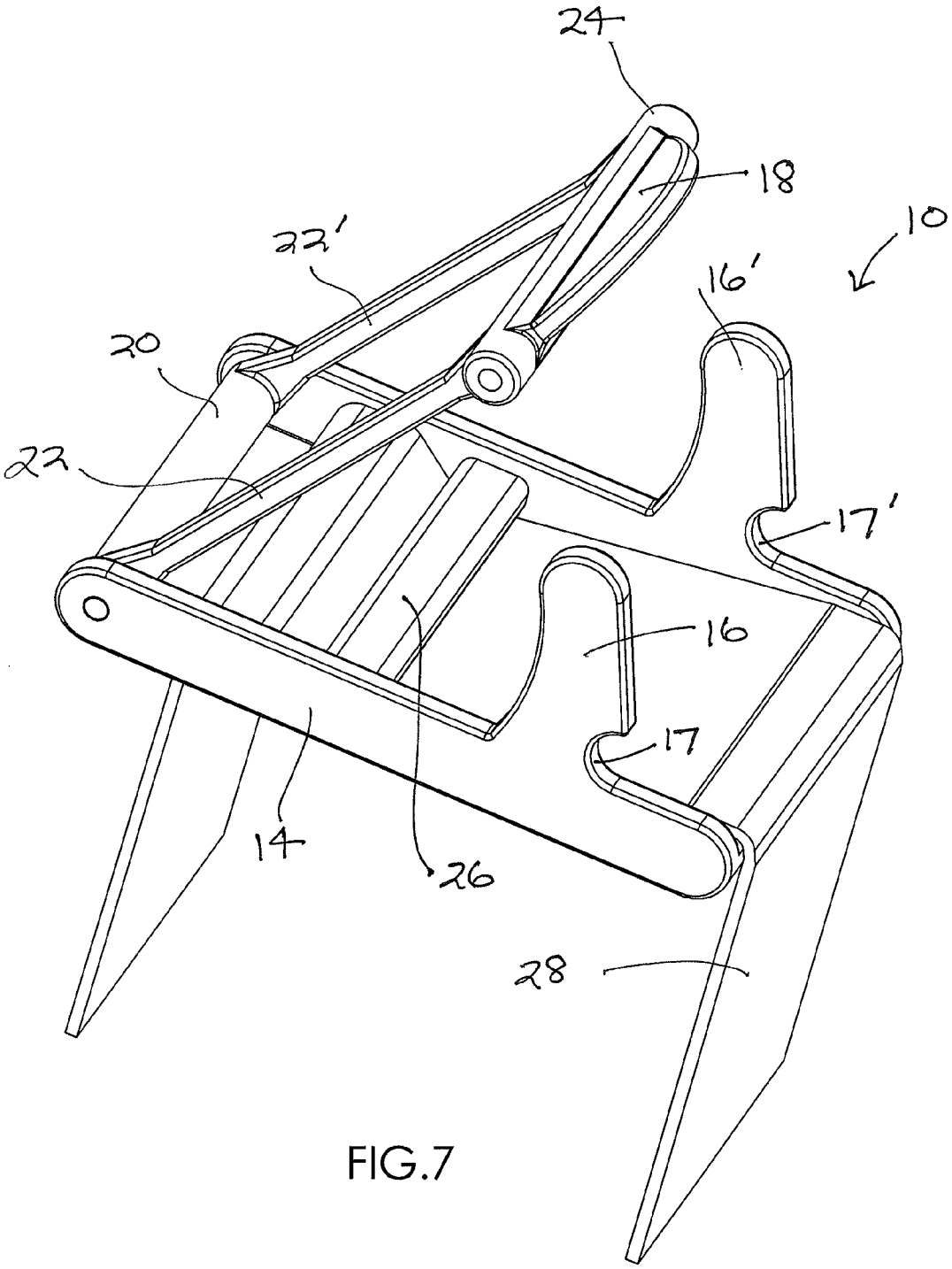
FIG. 7 is a top, distal, perspective view of the embodiment depicted in FIGS. 1-6, but with the clamp and the holder fastening strap disengaged.

FIG. 7 depicts the same features of the invention as depicted in FIG. 6, but with the clamp 18 and the holder fastening strap 28 disengaged.

Figure 8:
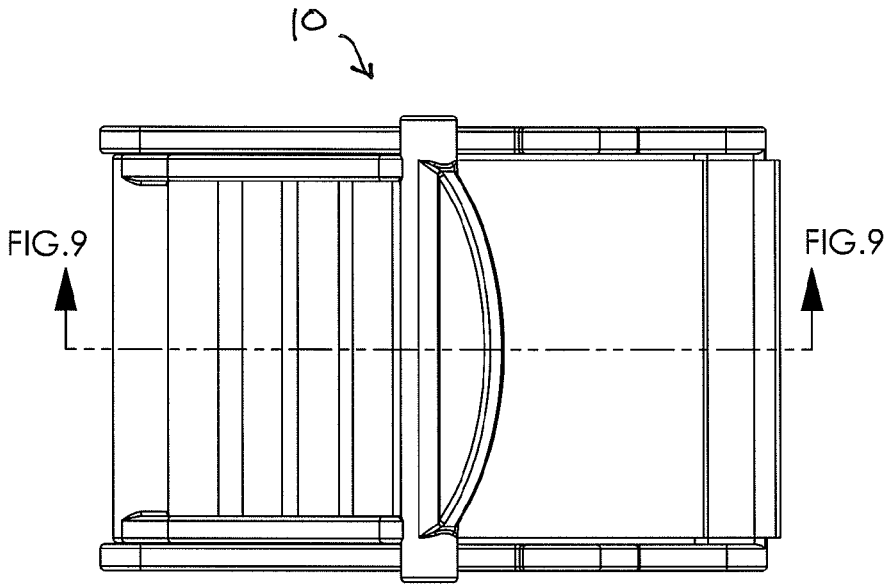
FIG. 8 is a top view of the embodiment depicted in FIG. 7.
Figure 9:
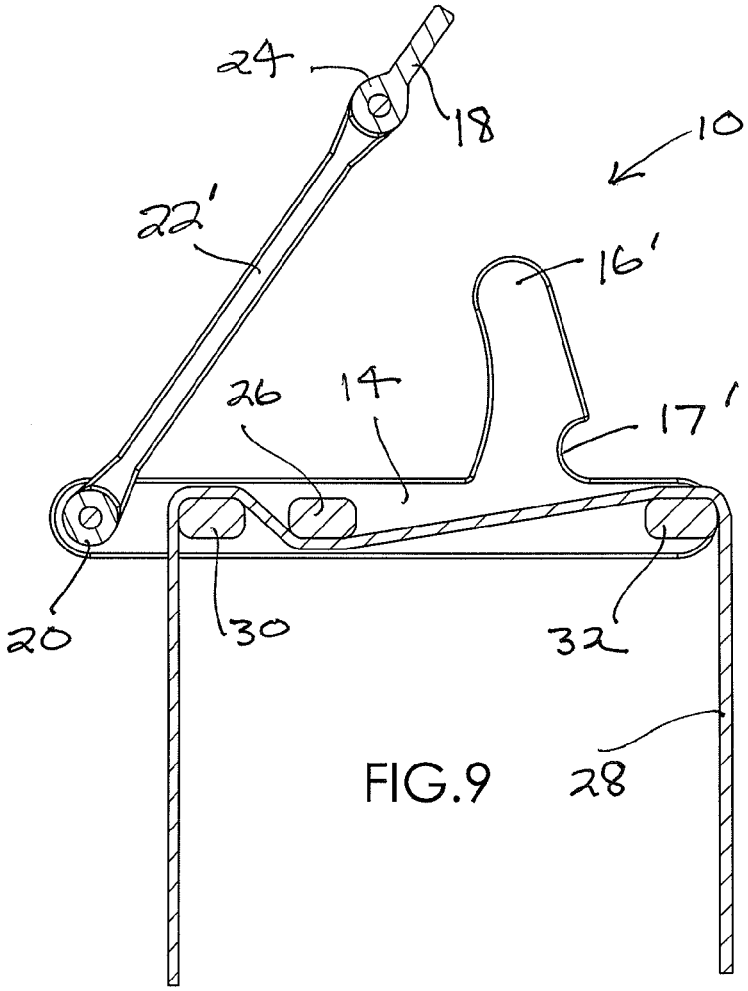
FIG. 9 is a side, cross-sectional view of the view depicted in FIG. 8, along dashed line 9-9 therein.

FIG. 8 is a top view, and FIG. 9 is a side, cross-sectional view of the view depicted in FIG. 7. From FIG. 9 it is apparent from viewing the Figure left-to-right that holder fastening strap 28 is threaded first over second transverse bar 30, then under first transverse bar 26 and finally over third transverse bar 32 before connecting with itself to interconnect with holder 10 at base 14. Fastening strap 28 may be made with appropriate hook and loop connectors, for example, so that, when the strap is overlapped on itself, as shown in FIG. 6, it is tightly held together so that it may be securely snugged-up and attached around a backpack or garment shoulder strap, for example.

Figure 10:
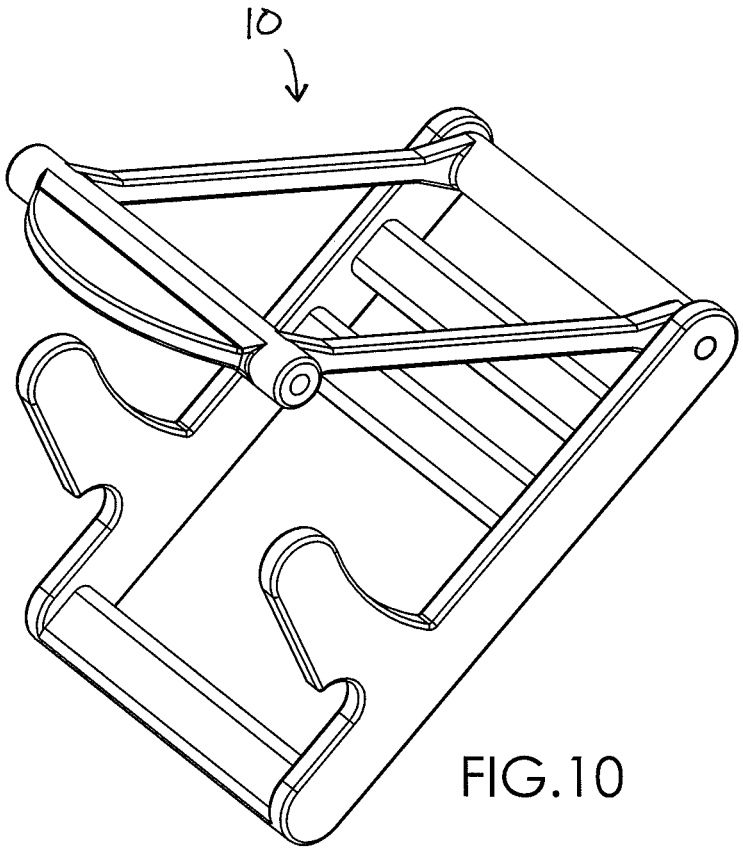
FIG. 10 is a top, perspective view of the embodiment depicted in FIGS. 7-9, but without the fastening strap present.
Figure 11:
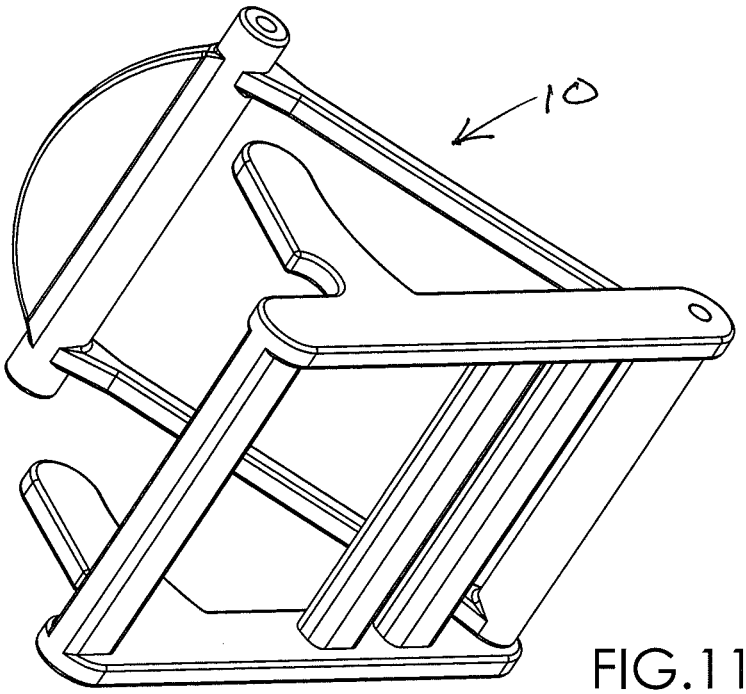
FIG. 11 is a bottom, perspective view of the view depicted in FIG. 10.

FIGS. 10 and 11, are, respectively, top and bottom perspective views of the holder 10 embodiment with clamp 18 disengaged and fastening strap 28 not present.

Figure 12:
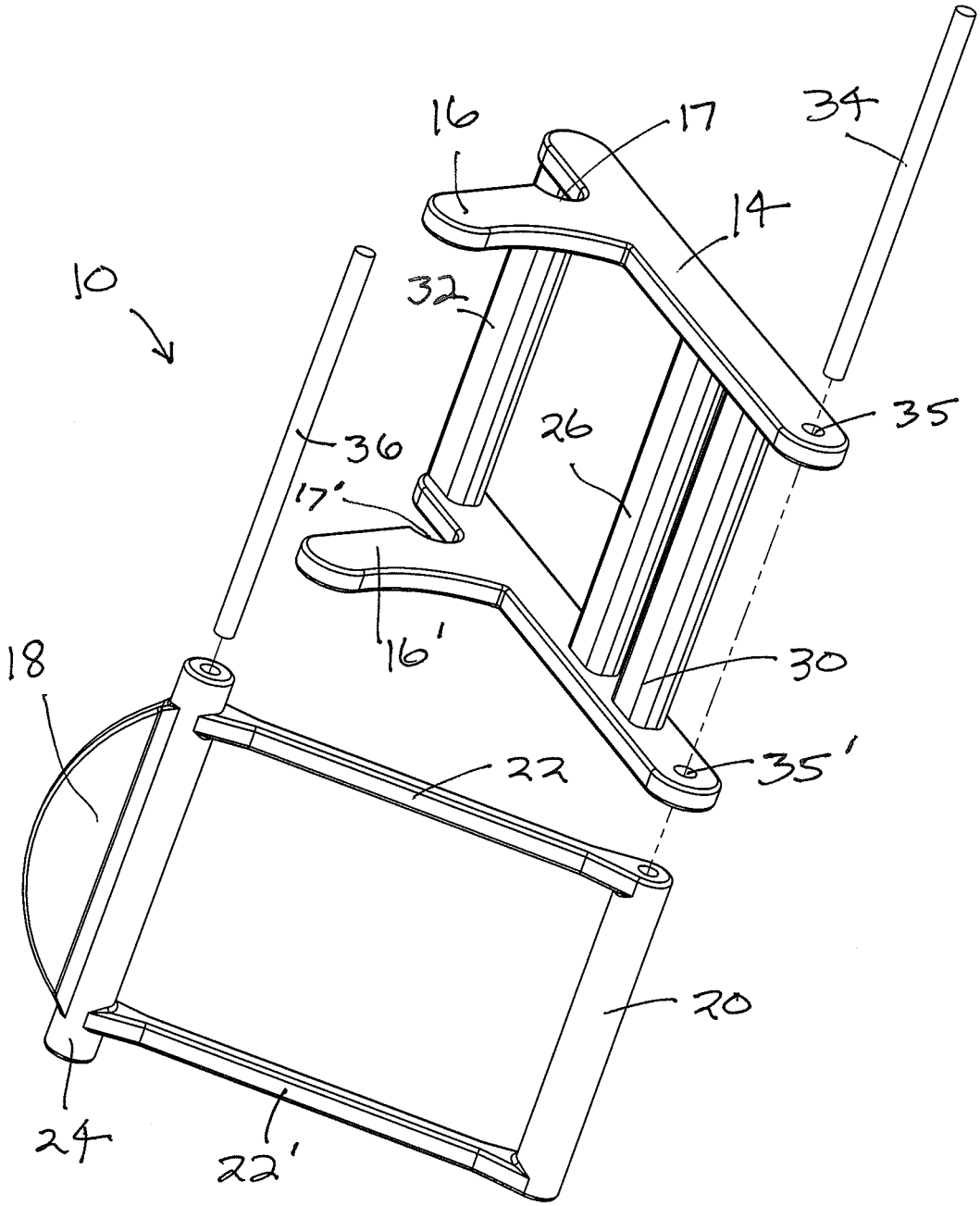
FIG. 12 is a top, proximal, perspective exploded view of the embodiment depicted in FIGS. 1-11, but without the fastening strap present.

FIG. 12 is an exploded view of the holder 10 embodiment. Newly depicted in FIG. 12 is axle bar 34 which fits inside clamp 18 attachment end 20, and also fits into indents or holes on each lateral side of base 14 near the proximal end thereof. This way, attachment end 20 may help clamp 18 rotate relative to base 14, however, rotation of clamp 18 is not necessary. Also newly depicted in FIG. 12 is reinforcement bar 36 which fits inside securement end 24 of clamp 18 to reinforce and rigidify it there.

An alternative embodiment of the invention is depicted in FIGS. 13-17.

Figure 13:
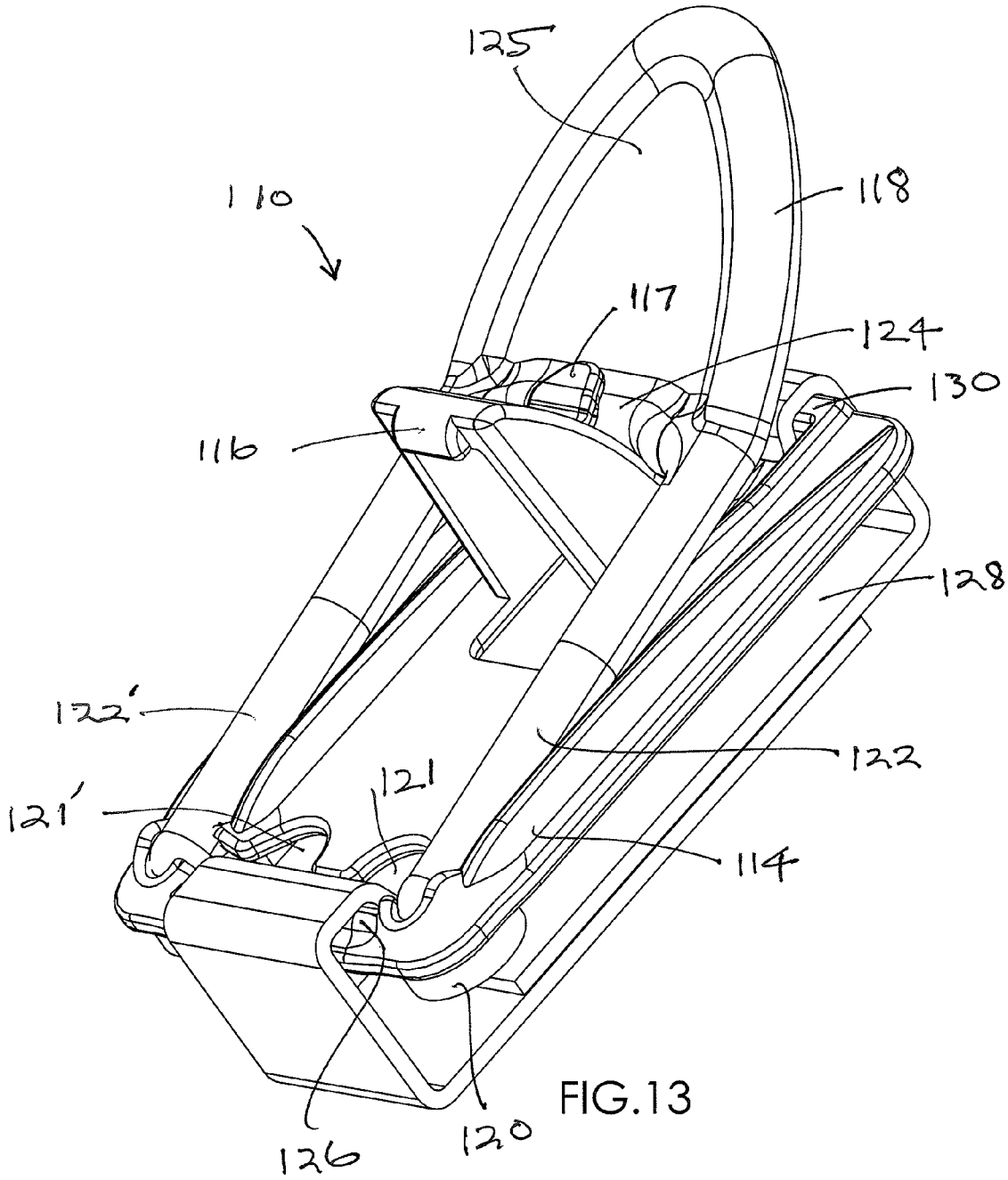
FIG. 13 is a view like FIG. 6, but of an alternative embodiment of the invention.

Referring to FIG. 13, there is depicted hook 110 for a rifle shoulder sling, the sling not being shown in this Figure. Hook 110 has base portion 114 with, in this case, one integrally formed upstanding prong 116 located towards the distal end of base portion 114. Preferably, prong 116 is between about ½-1½ inches high off the top of the middle portion of base 114. Prong 116 has distally extending tab 117 on prong's 116 distal end. The distal end of clamp 118 preferably stretches slightly and extends over the middle portion of base 114, and over the distal end of prong 116, to be secured under tab 117 at the securement end 124 of clamp 118. Preferably, clamp 118 is made of a stretchable elastic material, and comprises two proximal attachment ends 120 and 120' (attachment end 120' not being shown in this Figure). Clamp 118 also comprises two substantially parallel, preferably stretchable legs 122 and 122' secured through apertures 121 and 121' with attachment ends 120 and 120', respectively, in base 114. The distal ends of legs 122 and 122' terminate at securement end 124 of clamp 118. Clamp 118 has a convenient and effective flat, distal end region 125 for being easily grabbed by the thumb and fingers of a hand of the wearer.

Also depicted in FIG. 13 is proximal transverse bar 126 which extends between the sides of base 114 at the proximal end thereof, and distal transverse bar 130 which extends between sides of base 114 at the distal end thereof. Also depicted in FIG. 13 is holder fastening strap 128 which threads through apertures in the base 114 made by proximal transverse bar 126 and distal transverse bar 130.

Figure 14:
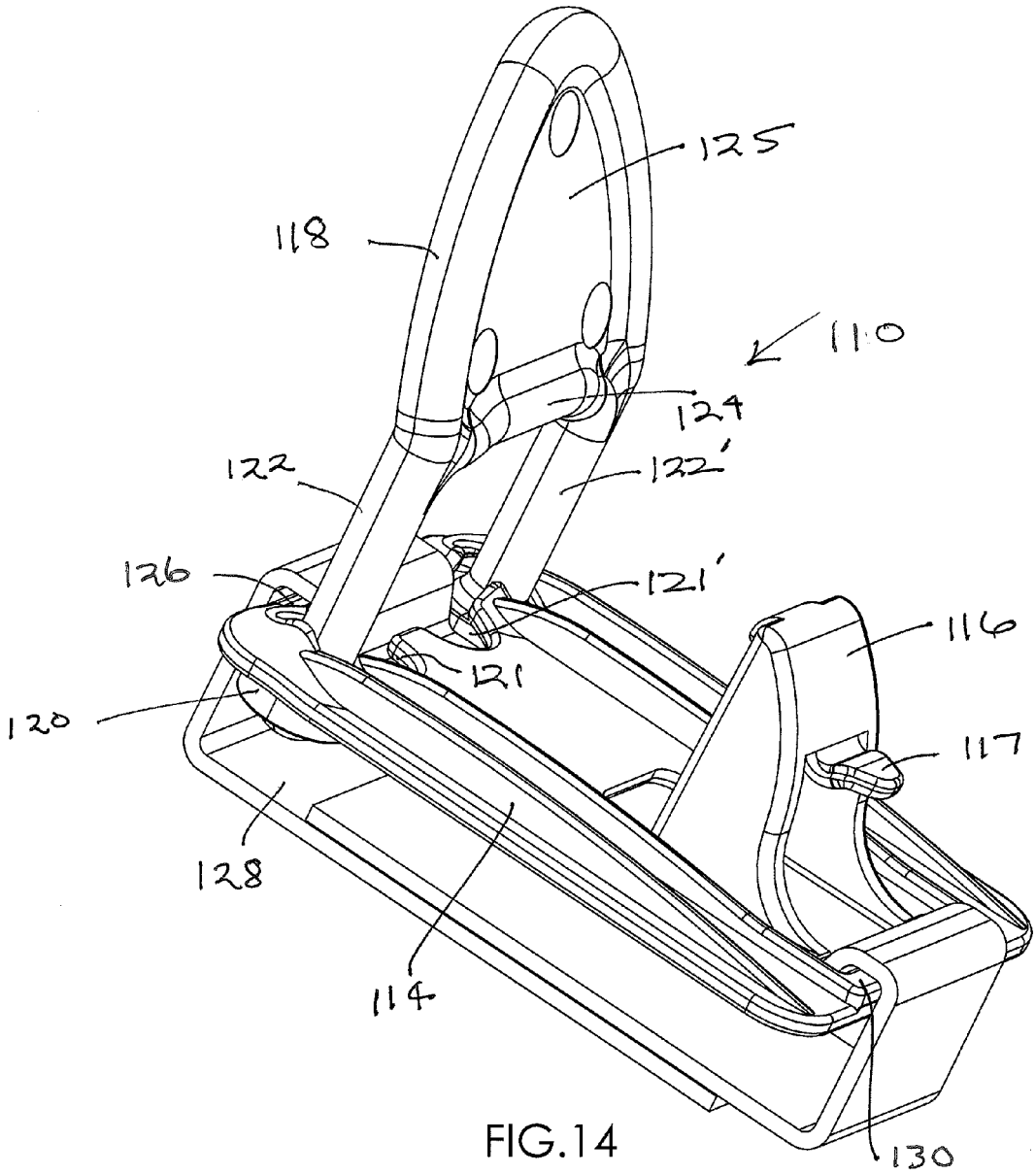
FIG. 14 is a view like FIG. 7, but with the alternative embodiment depicted in FIG. 13, and with the holder fastening strap engaged.

FIG. 14 depicts the same features of this embodiment of the invention as depicted in FIG. 13, but with the clamp 118 disengaged.

Figure 15:
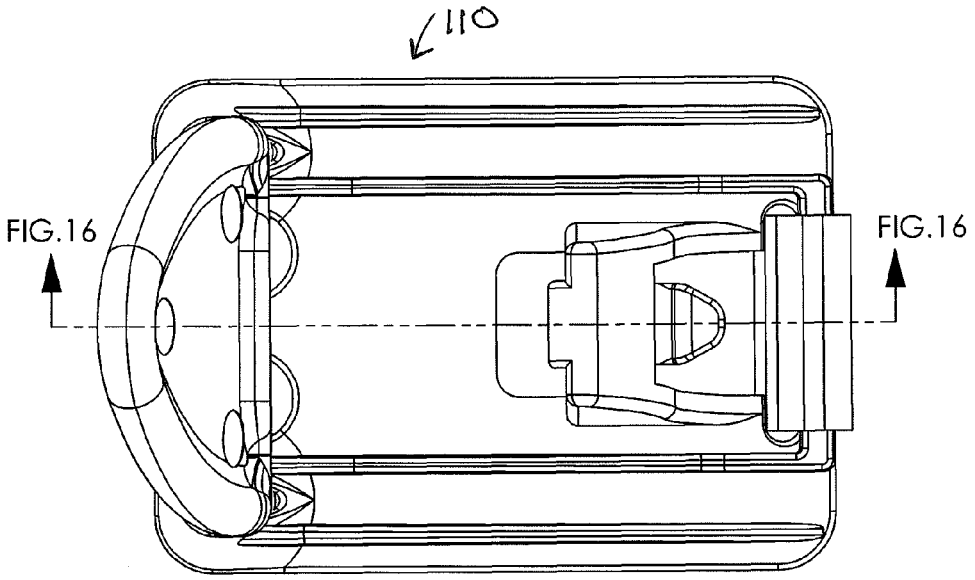
FIG. 15 is a top view of the embodiment depicted in FIG. 14.
Figure 16:
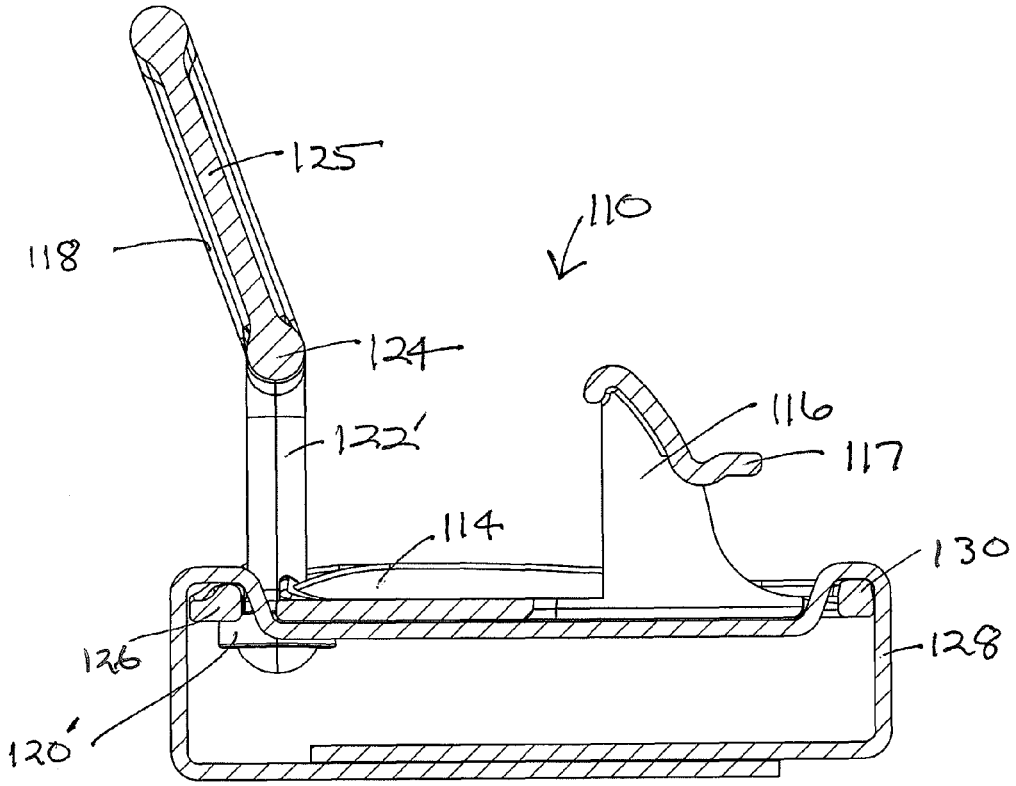
FIG. 16 is a side-cross-sectional view of the view depicted in FIG. 15, along dashed line 16-16 therein.

FIG. 15 is a top view, and FIG. 16 is a side, cross-sectional view, of the view depicted in FIG. 14. From FIG. 16 it is apparent from viewing the Figure left-to-right that holder fastening strap 128 is threaded over proximal transverse bar 126, under the middle portion of base 114, and over distal transverse bar 130 to interconnect with holder 110 at base 114. Fastening strap 128 may be made with appropriate hook and loop connectors, for example, so that when the strap is overlapped on itself it is tightly held together so that it may be securely snugged-up and attached around a backpack or garment shoulder strap, for example.

Figure 17:
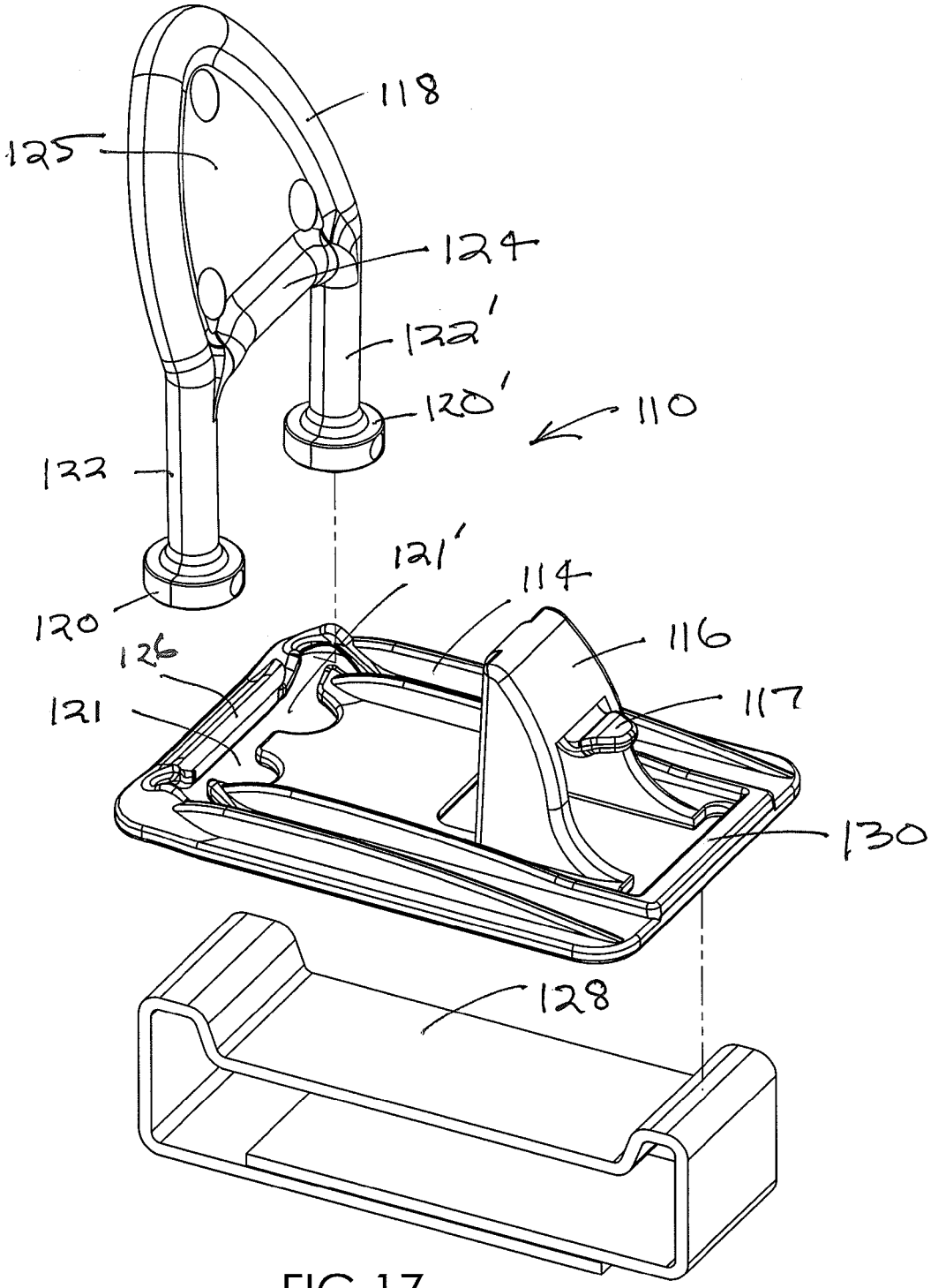
FIG. 17 is a top, proximal, perspective exploded view of the alternative embodiment depicted in FIGS. 13-16.

FIG. 17 is an exploded view of the holder 110 embodiment.

Although this invention has been described above with reference to particular means, materials and embodiments, it is to be understood that the invention is not limited to these disclosed particulars, but extends instead to all equivalents within the broad scope of the following claims.

I claim:

1. A hook for a shoulder sling, comprising:

a generally horizontal base with a first end, middle portion, and a second end, said base having an upstanding, upwardly-projecting prong, the prong having a bottom end located on said base near the base's second end, a lower distal section near said base, and a top end ½-1.5 inches above the base, said base having a generally horizontal moveable clamp of stretchable elastic material, said clamp being secured near the base's first end;

said base further comprising a fastening strap that threads through the base and is fastenable in a loop for securing the hook to a backpack strap; and, said moveable clamp being adapted to extend horizontally past said base's middle portion to said upstanding, upwardly-projecting prong to detachably engage with said distal section of the prong near said base, so that the movable clamp when detachably engaged with said distal section of the prong is close to and generally parallel to the generally horizontal base, for receiving an elongated strap horizontal portion in a first position between the middle portion of said base and the moveable clamp and in a second position above the middle portion of the base and the moveable clamp.

2. A hook for holding a shoulder sling on a user's shoulder, the hook comprising:

a generally horizontal base with a proximal end, middle portion, distal end, and a longitudinal axis and lateral sides extending between the proximal and distal ends, said base further comprising a fastening strap that threads through the base and is fastenable in a loop for securing the hook to a backpack strap;

a prong upending from the generally horizontal base near the distal end of the base, the prong having a bottom end at the base, a top end above the base, a distal side, a proximal side, a first lateral side, and a second lateral side; and a moveable clamp of stretchable elastic material, said clamp having a proximal portion and a distal portion, the proximal portion being secured to the base at a proximal connection near the proximal end of the base, and said moveable clamp extending generally horizontally, from said proximal connection, across said middle portion of the base, and along said first lateral side of the prong near the base, to a distal connection where the clamp detachably engages the distal side of the prong near said bottom end of the prong, so that, when detachably engaging the distal side of the prong, the clamp is close to and generally parallel to the generally horizontal base for receiving an elongated strap horizontal portion in a first position between the middle portion of said base and the moveable clamp and in a second position above the middle portion of the base and the moveable clamp.

3. The hook as in claim 2, further comprising an additional prong upending from the generally horizontal base near the distal end of the base, the additional prong having a bottom end at the base, a top end above the base, a distal side, a proximal side, and first and second lateral sides;

wherein said moveable clamp further extends generally horizontally from said proximal connection, past said middle portion of the base, and along the first lateral side of the additional prong near the base, to a distal connection where the clamp detachably engages to the distal side of the additional prong near said bottom end of the additional prong.

4. The hook as in claim 3, wherein the distal side of the prong and the distal side of the additional prong each have a detent section near the base, wherein said moveable clamp distal portion comprises a transverse member extending transversely relative to the lateral sides of the base and detachably engaging said detent section of the prong and said detent section of said additional prong.

5. The hook as in claim 4, wherein the transverse member has a first end engaging the distal section of the prong and an opposing end engaging the distal section of the additional prong.

6. The hook as in claim 2, wherein said moveable clamp further extends generally horizontally from said proximal connection, past said middle portion of the base, and along the second lateral side of the prong near the base, to said distal connection, so that the moveable clamp extends around said prong.

7. The hook system of claim 6, wherein the moveable clamp comprises two longitudinal legs that are connected by a transverse member that engages a detent section in said distal side of the prong near said bottom end of the prong.

8. A hook system, adapted to hold a shoulder sling of a weapon on a user's shoulder, comprising:

a backpack for being worn on a user's shoulders and back, the backpack comprising two backpack shoulder straps for hanging the backpack on the user's shoulders; and a hook that comprises:

a generally horizontal base with a proximal end, middle portion, distal end, and a longitudinal axis and lateral sides extending between the proximal and distal ends, wherein said base further comprises a fastening strap that threads through the base and fastens in a loop around either of the backpack shoulder straps to secure the hook to said either of the backpack shoulder straps to hold the base generally horizontally on the backpack shoulder strap above the user's shoulder; and, a prong upending from the generally horizontal base near the distal end of the base, the prong having a bottom end at the base, a top end above the base, a distal side, a proximal side, and first and second lateral sides;

a moveable clamp of stretchable elastic material having a proximal portion and a distal portion, the proximal portion being secured to the base at a proximal connection near the proximal end of the base, and said moveable clamp extending generally horizontally, from said proximal connection, across said middle portion of the base, and along the first lateral side of the prong near the base, to a distal connection where the clamp detachably engages the distal side of the prong near said prong's bottom end; and the hook system further comprising:

a weapon having an elongated shoulder sling, the shoulder sling extending across the hook transversely to said longitudinal axis of the base, and extending out beyond said lateral sides of the base, so that shoulder sling is restrained from sliding off the shoulder of a wearer by being held by the hook secured to said either of the backpack shoulder straps.

9. The hook system of claim 8, wherein said shoulder sling extends across the middle region of the base between the base and the moveable clamp, so that the moveable clamp holds the shoulder sling on said middle region.

10. The hook system of claim 8, wherein said shoulder sling extends transversely across the hook above the middle region of the base and above the clamp.

11. The hook system as in claim 8, further comprising an additional prong upending from the generally horizontal base near the distal end of the base, the additional prong having a bottom end at the base, a top end above the base, a distal side, a proximal side, and first and second lateral sides, and wherein said moveable clamp further extends generally horizontally, from said proximal connection, across said middle portion of the base, and along the first lateral side of the additional prong near the base, to a distal connection where the clamp detachably engages to the distal side of the additional prong near said bottom end of the additional prong.

12. The hook system as in claim 11, wherein the distal side of the prong and the distal side of the additional prong each have a detent section near the base, wherein said moveable clamp distal portion comprises a transverse member extending transversely relative to the lateral sides of the base and detachably engaging said detent section of the prong and said detent section of said additional prong.

13. The hook system as in claim 11, wherein the transverse member has a first end engaging the distal section of the prong and an opposing end engaging the distal section of the additional prong.

14. The hook system as in claim 8, wherein said moveable clamp further extends generally horizontally from said proximal connection, past said middle portion of the base, and along the second lateral side of prong near the base, to said distal connection, so that the moveable clamp extends around said prong.

15. The hook system of claim 14, wherein the moveable clamp comprises two longitudinal legs that are connected by a transverse member that engages a detent section in said distal side of the prong near said bottom end of the prong.

16. The hook system of claim 8, wherein in a first position said shoulder sling extends transversely across the middle region of the base between the base and the moveable clamp, so that the moveable clamp holds the shoulder sling on said middle region, and wherein in a second position said shoulder sling extends transversely across the hook above the middle region of the base and above the clamp so that the shoulder sling is held on the hook by the prong but not clamped down.

* * * * *